United States Patent [19]

Murata

[11] Patent Number: 4,754,634

[45] Date of Patent: Jul. 5, 1988

[54] DEVICE FOR FORMING BEAD TO PIPE

[76] Inventor: Sakae Murata, 52-13, Nishi-Honcho, Ohta-Shi, Gunma-Ken, Japan

[21] Appl. No.: 40,790

[22] Filed: Apr. 21, 1987

[30] Foreign Application Priority Data

Jun. 26, 1986 [JP] Japan ..... 61-98173[U]

[51] Int. Cl.[4] ..... B21D 41/00

[52] U.S. Cl. ..... 72/318; 72/317

[58] Field of Search ..... 72/317, 318, 125, 115–117, 72/454, 481, 316

[56] References Cited

U.S. PATENT DOCUMENTS

| | | | |
|---|---|---|---|
| 919,924 | 4/1909 | McQuaide | 72/481 |
| 3,109,479 | 11/1963 | Wolcott | 72/317 |
| 3,209,571 | 10/1965 | Wilson | 72/125 |
| 3,842,652 | 10/1974 | Yonezawa et al. | 72/454 |
| 4,535,616 | 8/1985 | Eason | 72/317 |

FOREIGN PATENT DOCUMENTS

| | | | |
|---|---|---|---|
| 77467 | 10/1894 | Fed. Rep. of Germany | 72/117 |
| 1207464 | 10/1970 | United Kingdom | 72/318 |

*Primary Examiner*—Daniel C. Crane

*Attorney, Agent, or Firm*—Fred Philpitt

[57] ABSTRACT

The device is composed of an inverted-U-shaped frame, a jig and a pipe fixture, and the inverted-U-frame is formed in such a way that the inverted-U-frame is formed in an inverted-U-shape and being formed with two pieces of leg portions for liftably guiding the jig, and a clamping screw shaft is provided for applying pressure to the jig disposed between the leg portions and a clasp is provided for holding the jig disposed between the leg portions on the clamping screw shaft and mount base portions are provided for mounting the pipe fixture at the lower portions of the leg portions, and the jig is formed as a pressure element formed with an annular groove for engaging the pawls of the clasp on an upper portion of its outer periphery, and for example, the pipe fixture that holds the end portion of an aluminum pipe in condition where the end portion of the pipe projects upward in a desired length is mounted at the mount base portions of the inverted-U-frame, and when the clamping screw shaft is screwed in, the pressure element descends to form a bead to the connecting end portion of the pipe, namely, the portion in the vicinity of the end of the pipe to enlarge it to form a ring-like flange integrally.

3 Claims, 2 Drawing Sheets

DEVICE FOR FORMING BEAD TO PIPE

BACKGROUND OF THE INVENTION

This invention relates to a device for forming a bead to pipe, and more particularly to a device for forming a bead to pipe which is composed of an inverted-U-shape frame consisting of two pieces of leg portions for guiding a jig downwardly, a clamping screw shaft engaged with an upper frame portion of the inverted-U-shape frame by means of a thread to apply a pressure to the jig disposed between the two pieces of the leg portions to move downwardly, a clasp to position and hold the jig disposed between the leg portions on the clamping screw shaft, and mount base portions for mounting a pipe fixture at the leg portions, and the jig is formed as a pressure element formed with an annular groove to engage a pawl portion of the clasp in the upper part of the side surface, and the pipe fixture is formed to hold the end portion of a pipe such as aluminum pipe used for piping of car cooler of the pipe firmly in a condition where the desired length of the pipe projects upward, and the jig or the pressure element disposed between the leg portions of the inverted-U-shape frame is caused to descend to apply pressure to the end portion of the pipe, and a flange is formed in the vicinity of the end of the pipe to enlarge by the formation of a bead.

Heretofore, for example, for connection of a piping of a car cooler to a mounting wall of a compressor and the like, as shown in FIG. 5, a pipe P is provided which has a bead portion integrally formed with a flange 2 in the vicinity of an end portion 1 of the pipe P. However, since the process of forming the flange 2 at the end portion of the conventional pipe P is an extremely difficult that requires two processes, the pipe P having the foregoing flange 2 is currently produced only in the plant production, and accordingly, for example, in case of exchanging and repairing the pipe P having the flange 2 as shown in FIG. 5 at a repair site, the work becomes extremely inconvenient. Therefore, at present, at the repair site and the like, a handy device capable of forming the flange 2 as shown in FIG. 5 simply on the end of the pipe is desired to be available.

SUMMARY OF THE INVENTION

An object of this invention is to provide a device for forming a bead to an end portion of a pipe which comprises an inverted-U-shape frame having two pieces of leg portions forming an inverted-U-shape and having a clamping screw shaft running through from an upper surface to a lower surface of an upper frame portion, a jib or a pressure element disposed between the leg portions of the inverted-U-frame, and a pipe fixture disposed at lower positions of the leg portions of the inverted-U-frame which holds the end of the pipe by arranging it to project only in a desired length, whereby this device is a handy repair tool for applying two processes necessary to form a flange easily and simply by a simple manipulation of merely screwing the clamping screw shaft and an exchange of the jig is easy, and this device enables a repair man to apply a process of forming a flange in the vicinity of a pipe at a repair site and the like easily and simply.

Another object of this invention is to hold a jig disposed between the leg portions of the inverted-U-frame exchangeably on the clamping screw shaft by a clasp provided on the clamping screw shaft and at the same time to make the pipe fixture to be easily detachable at the leg portions of the inverted-U-frame.

A still another object of this invention is to engage pawl portions of lower ends of the clasps with an annular groove of a pressure element upon completion of clamping of the clamping screw shaft and to elevate the pressure element together which is accompanied by the rising of the clamping screw shaft in case the clamping is released by reversing the clamping screw shaft, and particularly, the pull-out of the pressure element from the short shaft of the pipe becomes easy and simple after the clamping of the second process.

A yet still further object of this invention is to provide pawl portions at lower ends of the clasp and to form an annular groove on the pressure element to facilitate easy and simple attachment and detachment of the clasp from the pressure element.

DETAILED DESCRIPTION OF THE INVENTION

Figure 1:
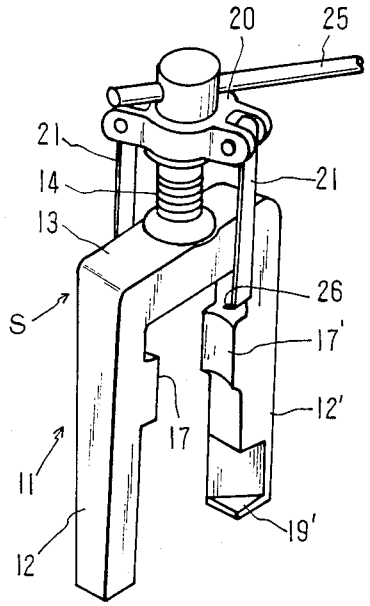
FIG. 1 is a perspective view of an inverted-U-frame.
Figure 3:
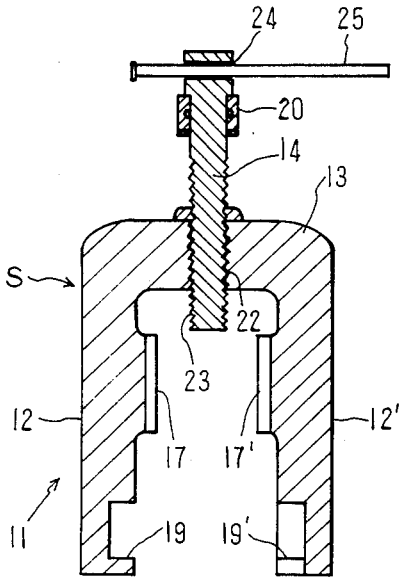
FIG. 3 is a cross section of the inverted-U-frame.

A device according to this invention indicated by a normal letter S consists of an inverted-U-frame 11, two pieces of jigs 15, 16 installed detachably on the inverted-U-frame 11 and a pipe fixture 18 that holds a pipe P firmly is installed on the inverted-U-frame 11.

The inverted-U-shaped frame 11 is provided with two pieces of parallelly disposed leg portions 12, 12', and a clamping screw shaft 14 runs through from an upper surface to a lower surface in the center of an upper frame portion 13 of the inverted-U-frame 11 in screw engagement. Lift guide portions 17, 17' of the jigs 15, 16 are provided at center height positions of the respective insides of the two pieces of the leg portions 12, 12' and mount base portions 19, 19' for mounting the pipe fixture 18 are provided at the lower ends of the leg portions 12, 12'. On the upper portion of the clamping screw shaft 14, a bearing portion 20 is mounted and clasps 21, 21 are pivotally fixed at their upper ends on the right and left portions of the bearing portion 20, and the jigs 15, 16 to be disposed on the lift guide portions 17, 17' of the two pieces of the leg portions 12, 12' are attached to the clamping screw shaft 14, and the pipe fixture 18 is mounted on the mount base portions 19, 19' provided at the lower ends of the leg portions 12, 12'.

A screw hole 22 that runs through the upper surface to the lower surface of the upper frame portion 13 is formed in the center of the upper frame portion 13 of the inverted-U-frame 11, and the clamping screw shaft 14 is provided with a screw portion 23 to be screwed to the screw hole 22, and this clamping screw 14 is engaged with the screw hole 22. The clamping screw shaft 14 is manipulated with a bar handle 25 inserted into the through hole 24 formed on the end portion of the bearing 20.

The clasp 21 is provided with pawl portions 26 at the lower ends which are bent inwardly, and the pawl portions 26 are positioned lower than the upper frame 13 of the inverted-U-frame 11, and the jigs 15, 16 are formed with an annular groove 27 for engaging the pawl portions 26 of the clasp 21 at their upper outer peripheral portions. The pawl portions 26 of the clasp 21 are engaged with the annular groove 27 of the jigs 15, 16 dispsoed at the lift guide portions 17, 17' of the leg portions 12, 12' of the inverted-U-frame 11 to attach the jigs 15, 16 to the clamping screw shaft 14, and the jigs 15, 16 are caused to descend by the turning of the clamping screw shaft 14, or the jigs 15, 16 are caused to ascend by turning the clamping screw shaft 14 that moves upward.

Figure 2A:
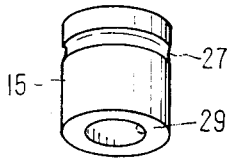
FIG. 2(*a*) is a perspective view showing a pressure element for the first process, FIG. 2(*b*) is a perspective view showing a pressure element for the second process.
Figure 2B:
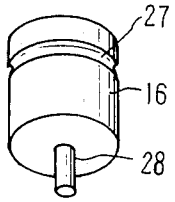

Although the external shape of the jigs 15, 16 is not particularly specified, in order to facilitate easy detachment or attachment of the jigs 15, 16 against the lift guide portions 17, 17' provided at the leg portions 12, 12' of the inverted-U-frame 11, in the embodiment of this device, as shown in FIGS. 2(*a*) and (*b*), the jig is formed in a columnar shape pressure element. However, the pressure element 15 used for the first process is formed with a recess portion 29 on its lower surface as shown in FIG. 2(*a*), and the pressure element 16 used for the second process is formed with a short shaft 28 integrally formed on its lower surface as shown in FIG. 2(*b*).

Figure 4:
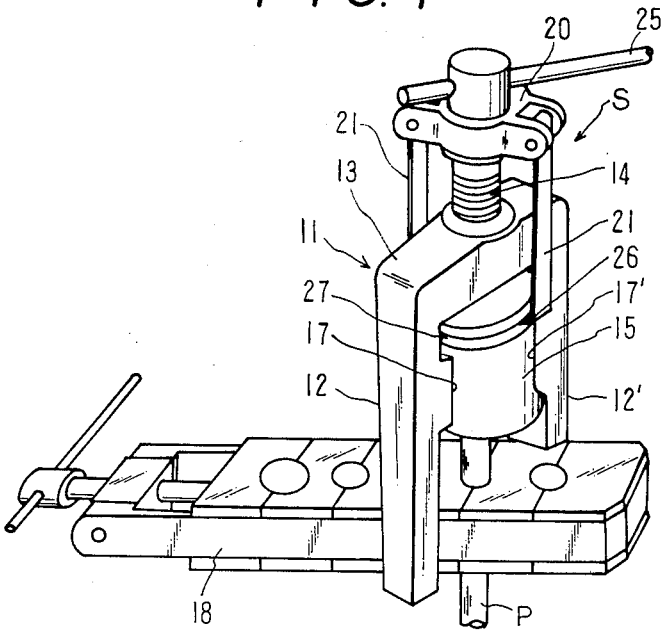
FIG. 4 is a perspective view showing an assembly of a jig and pipe fixture with the inverted-U-shape frame.

By the way, the pipe fixture 18 may be of any kind as long as the end portion of the pipe P is fixed and retained in condition where the pipe end projects only in a desired length, but in the embodiment of this invention, as shown in FIG. 4, a pipe fixture that is conventionally used may be used.

In case of a process of forming a bead to a connecting end portion of the pipe P using the device according to this invention, the jig for the first process, namely, the pressure element 15 is installed at the lift guide portions 17, 17' between the two pieces of the leg portions 12, 12' of the inverted-U-frame 11 and the two pieces of the pawl portions of the clasp 21 are engaged and suspended in the annular groove 27 of the pressure element 15 and then, the pipe fixture 18 fixed with the pipe P to be processed is mounted at the mount base portions 19, 19' provided at the lower ends of the leg portions 12, 12' of the inverted-U-frame 11 and is fixed. When the bar handle 25 is turned until the clamping of the clamping screw shaft 14 is completed, the pressure element 15 is descended by the clamping of the clamping screw shaft 14 to apply the first process to the end portion of the pipe P. After the clamping is over, the bar handle 25 is reversed, and then, the pressure element 15 is elevated by means of the clasp 21. When the first process is over, the pipe fixture 18 is removed from the inverted-U-frame 11 and the clasp 21 is removed from the pressure element 15 to be detached from the inverted-U-frame 11 and the pressure element 15 is replaced with the jig for the second process, namely, the pressure element 16.

Figure 5:
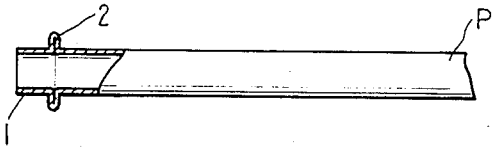
FIG. 5 is an elevation showing a partially cut-out of a pipe formed with a flange by a process of forming a bead.

The pressure element 16 is engaged and suspended in the annular groove 27 by means of the clasp 21 similar to the foregoing description, and then, the pipe fixture 18 fixed with the pipe P having undergone the first process is mounted and fixed at the mount base portions 19, 19' of the leg portions 12, 12' of the inverted-U-frame 11, and when the clamping operation similar to the foregoing description is effected, the flange 2 that is enlarged like a collar which is provided with an inserting portion 1 is formed as shown in FIG. 5.

After the clamping is over, the bar handle 25 is reversed to elevate the pressure element 16 by means of the clasp 21. The short shaft 28 provided on the pressure element 26 for the second process is inserted into the inserting portion 1 of the end of the pipe P to be firmly clamped but the pressure element 16 engaged with the clasp 21 is jointly elevated according to the reversal rising of the clamping screw shaft 14 to pull out the short shaft 28 from the inserting portion 1 of the pipe P with extreme easiness.

In the condition where the pawl portion 26 rises and is engaged and suspended with the clasp 21, the pipe fixture 18 is detached from the inverted-U-frame 11. The pipe P is detached from the pipe fixture 18 and the resulting pipe is ready for use.

Accordingly, this invention is to provide a repair device as a useful hand tool by exchanging the pressure elements and facilitating the two processes necessary for the formation of the flange easily and simply, and thus, the ring-like flange can be easily and simply formed on the end of the pipe at a repair site, and moreover, the attachment and detachment of the pressure elements and the pipe fixture can be easily effected by the clasp provided on the clamping fixture, and moreover, the pull out of the short shaft of the pressure element in the clamped condition upon insertion to the end portion of the pipe in the second process can be effected remarkably easily and simply which are advantageous points of this invention.

What is claimed is:

1. A device for forming a bead adjacent the end of a pipe comprising in combination (a) a frame (11) in the form of an inverted U that includes two downwardly depending leg portins (12, 12') and an upper portion (13) that connects said leg portions (12, 12') together at their upper ends, (b) a clamping screw shaft (14) having upper and lower ends extending through said upper portion (13) of said frame (11), (c) guide portions (17, 17') located on the inner mid portions of said leg portions (12, 12'), said guide portions being adapted to closely surround and guide a pipe deforming pressure element (15, 16) positioned therebetween, (d) a pipe deforming pressure element (15, 16) slidably positioned between said guide portions (17, 17'), said element having an annular groove (27), (e) a pipe gripping member (18) that is adapted to surround and securely grip a portion of a pipe (P), (f) holding portions (19, 19') located adjacent lower extremities of said leg portions (12, 12'), said holding portions (19, 19') holding said pipe gripping member (18) in a stationary position between said leg portions (12, 12'), (g) a clasping member (21) attached to and movable with the upper end of said clamping screw shaft (14) and having two clasping legs that depend downwardly and which are shaped so as to be able to engage said annular groove (27) in said pipe deforming pressure element (15, 16) when said pressure element is positioned between said leg portions (12, 12'), and (h) means (20, 24, 25) at the upper end of the screw shaft (14) to rotate said clamping screw shaft (14) so that the lower end of said shaft will bear against and progressively press downwardly the pipe deforming pressure element (15, 16) that is located between said guide portions (17, 17') thereby applying deforming pressure against the end of a pipe (P) held by said pipe gripping member (18).

2. A device according to claim 1 wherein said pressure element (15) has a recess (29) in its lower surface that is adapted to engage the upper end of said pipe (P).

3. A device according to claim 1 wherein said pressure element (16) has a short shaft on its lower surface which is adapted to engage the upper end of a pipe (P).

* * * * *